US005732677A

United States Patent [19]

Baca

[11] Patent Number: 5,732,677

[45] Date of Patent: Mar. 31, 1998

[54] INTERNAL COMBUSTION ENGINE WITH EIGHT STROKE OPERATING CYCLE

[76] Inventor: Arthur C. Baca, 743 W. 700 N., Clearfield, Utah 84015

[21] Appl. No.: 636,542

[22] Filed: Apr. 25, 1996

[51] Int. Cl.[6] ..... F02B 19/02

[52] U.S. Cl. ..... 123/316; 123/64

[58] Field of Search ..... 123/316, 64, 63

[56] References Cited

U.S. PATENT DOCUMENTS

| | | | |
|---|---|---|---|
| 3,710,767 | 1/1973 | Smith | 123/63 |
| 4,289,097 | 9/1981 | Ward | 123/64 |
| 4,565,167 | 1/1986 | Bryant | 123/70 R |
| 4,641,613 | 2/1987 | Delesalle | 123/64 |
| 4,809,511 | 3/1989 | Bajulaz | 60/712 |
| 4,917,054 | 4/1990 | Schmitz | 123/64 |
| 5,010,860 | 4/1991 | Broussard | 123/64 |
| 5,201,907 | 4/1993 | Hitomi et al. | 123/316 |

FOREIGN PATENT DOCUMENTS

| | | | |
|---|---|---|---|
| 3042313 | 6/1982 | Germany | 123/64 |
| 11416 | 3/1908 | United Kingdom | 123/64 |
| 2057052 | 3/1981 | United Kingdom | 123/64 |

*Primary Examiner*—David A. Okonsky
*Attorney, Agent, or Firm*—A. Ray Osburn

[57] ABSTRACT

An inventive internal combustion engine adapted for an eight piston stroke operating cycle. The rate of comsumption of fuel and air mixture, and the pressure at which it is ignited and combusted, is enhanced by the addition of a holding chamber for fuel and air mixture which retains an initial intake charge of mixture to be later mixed with a subsequent intake charge before compression and combustion within the cylinder. The engine is therefore capable of greater power with given size cylinders. Conversely, the engine is capable of producing a target rate of fuel consumption and power output with smaller cylinders. The engine may also be designed to operate in a Diesel manner utilizing an appropriate hydrocarbon fuel.

10 Claims, 5 Drawing Sheets

INTERNAL COMBUSTION ENGINE WITH EIGHT STROKE OPERATING CYCLE

BACKGROUND OF THE INVENTION

1. Field

The field of the invention is internal combustion engines which produce power by burning a fuel and air mixture, causing it to expand within a chamber to cause motion of a piston connected to rotate a power output shaft.

2. State of the Art

Internal combustion engines are most typically selected from two and four piston stroke cycle designs, with the latter being used to propel gasoline burning vehicles. The thermal efficiency of such engines, including the widely used four stroke cycle engine, is very low, in the neighborhood of 25%. The required size and weight of such engines often limit the output power, since the rate of fuel consumption is practically limited by the combustion chamber size. The mixture before compression is in these engines always at atmospheric pressure within the combustion chamber.

A need therefore exists for an internal combustion engine wherein the combustion chamber is charged with pressurized fuel and air mixture prior to the compression piston stroke preceding the power stroke. Such an engine would have increased efficiency because of the greater amount of mixture combusted per cycle and higher combustion pressures. It would also be volumetrically efficient, since smaller combustion chambers could be utilized at any selected fuel consumption rate. A size limited engine could be utilized to burn fuel at a higher more efficient rate in each cylinder.

BRIEF SUMMARY OF THE INVENTION

With the foregoing in mind, the shortcomings and disadvantages of prior art internal combustion engines are eliminated or substantially alleviated by the present invention, which provides an internal combustion engine having pistons each of which executes eight strokes within a cylinder during each engine operating cycle, beginning with intake of fuel and air mixture and ending with expulsion of spent exhaust gases after combustion.

The inventive engine has combustion units each comprising a combustible mixture holding chamber in addition to a state of the art cylinder with a reciprocating piston. The holding chamber has a valve for opening and closing a port communicating with the interior of the cylinder. The cylinder has valves controlling flow through fuel mixture inlet and exhaust ports. The valves may be cam operated as in conventional engines, or electronically timed and powered, if preferred.

The operating cycle of each combustion unit is characterized by initial intake of fuel and air mixture to fill the cylinder, subsequent transfer of the mixture to the holding chamber for temporary storage, intake of another cylinder full of fuel and air mixture, transfer of the additional fuel and air mixture into the holding chamber to mix with the previous mixture stored therein at an elevated pressure, intake of fuel and air mixture at elevated pressure into the cylinder from the holding chamber, compression and ignition of the mixture in the cylinder, producing a power stroke of the piston. Finally, the residual products of combustion are exhausted from the cylinder by the last piston stroke of the cycle. However, the holding chamber retains a pressurized charge of fuel and air mixture which is consumed during the succeeding cycle.

Thus, the first quantity of combustible mixture taken in during each cycle becomes pressurized when forced from the cylinder into the holding chamber by the second stroke, by mixture with this residual mixture therein from the previous cycle. This mixed charge remains trapped in the holding chamber at elevated pressure until further charged with an additional amount of mixture from the cylinder by the fourth piston stroke.

The mixture finally drawn into the cylinder for combustion is therefore at elevated pressure, and has correspondingly increased energy for release by subsequent combustion during the power stroke, the seventh. This increases the volumetric efficiency of the engine. i.e., smaller engines may operate to achieve a desired level of power higher than can be realized with state of the art engines. The thermal efficiency of the combustion is enhanced by more efficient combustion at higher pressures, because of the higher pressure of the mixture at the start of the compression stroke.

Additionally, the initial charges stored in the holding chamber may if desired be preheated by addition of otherwise wasted heat energy from recirculated engine exhaust gases.

To accomplish the eight phases of the cycle, each cylinder has a valve of standard type controlling the inlet of fuel and air mixture from the carburetion system, and an exhaust valve controlling the expunging from the cylinder of spent gases after combustion, and a valve controlling the entry and exit of gases from the holding chamber. As with prior art internal combustion engines, each cylinder may be provided with a starting spark as by a standard spark plug.

In an embodiment of the inventive engine for Diesel operation, a fuel injection device is provided in lieu of sparking device. Uncarbureted ambient air is ingested into the cylinder during the intake strokes, transferred into the holding chamber, and finally pressurized during the compression stroke, which raises the temperature of the contents of the combustion chamber to a level sufficient to ignite fuel which is injected into the cylinder for combustion during the power stroke of the eight-stroke cycle.

The principal object of the invention is to provide an internal combustion engine with improved volumetric and thermal efficiency.

BRIEF DESCRIPTION OF THE DRAWINGS

In the drawings, which represent the best modes for carrying out invention.

DETAILED DESCRIPTION OF ILLUSTRATED EMBODIMENTS

Figure 2:
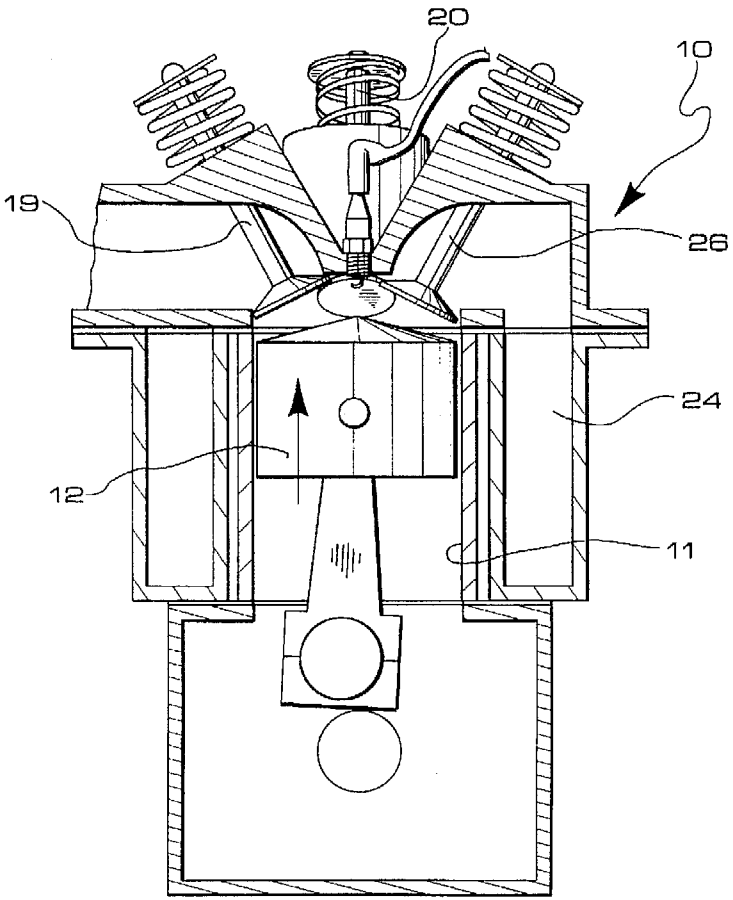

The inventive engine 10 comprises at least one combination of a combustion cylinder 11, a piston 12, a crankshaft 13, and a connecting rod 14. (FIG. 1) Cylinder 11 opens downwardly into a crankcase 15, into which the piston rod extends to connect the piston to the crankshaft. Cylinder 11 is closed at its upper end by a head member 16. A pair of ports 17 and 18 are carried by head member 16 for intake of combustible air and fuel mixtures and for exhaust of residual spent gases after combustion within the cylinder. The ports 17 and 18 are equipped with shut-off valves 19 and 20 respectively of conventional design. The cylinder 11 is incorporated into an engine block 21, which includes coolant passages 22. A spark plug 23 is installed in head member 16.

A mixture holding chamber 24 communicates with the interior of cylinder 11 through chamber port 25, which is opened and closed by a valve 26. Cams 27, 28 and 29 open and close the intake, exhaust, and holding chamber valves 19, 20 and 26 respectively. The three cams are each mounted to rotate with associated crankshafts 30, 31 and 32, the rotations of which are synchronized with that of crankshaft 13 by connecting gearing, not shown.

Also associated with the above described assemblage but not shown are standard internal combustion engine accompaniments including an exhaust manifold, an exhaust pipe system to dispose of the gases, and a carburetion system providing combustible mixtures of fuel and air to be taken into cylinder 11. It is anticipated that the illustrated assemblage would be used in multiples, analogous to prior art four, six and eight cylinder four stroke cycle engine designs.

The operation of the eight stroke cycle engine 10 is now described in detail with reference to FIGS. 1–8, each illustrating positions of the reciprocating piston 12, the intake and exhaust valves 19 and 20, and the holding chamber valve 26 at various times in the cycle.

Figure 1:
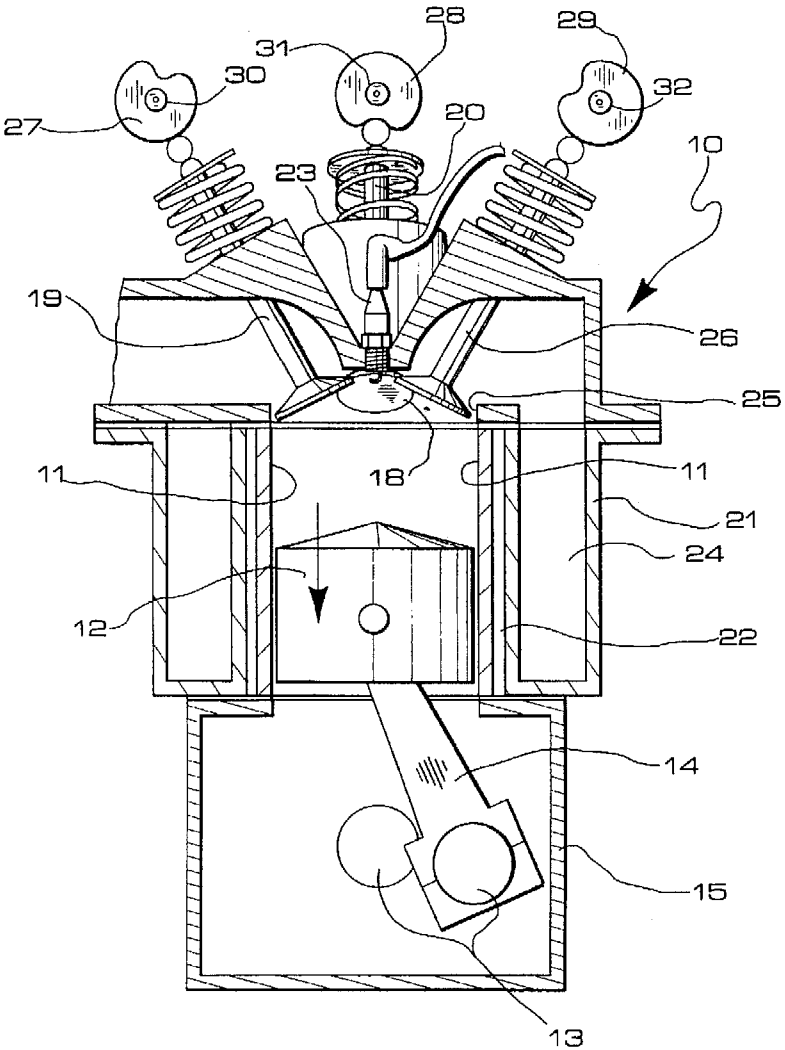
FIG. 1 is a vertical sectional view of a combustion unit of the inventive right-stroke cycle internal combustion engine, shown executing the first stroke of the eight-stroke cycle, the piston thereof moving downwardly to draw a mixture of fuel and air into the cylinder, intake valve and holding chamber valve being open, drawn to a somewhat reduced scale, FIG. 2 the combustion unit of FIG. 1 shown at the end of the second stroke, transferring fuel and air mixture from the cylinder to the holding chamber, drawn to the same scale, FIG. 3 combustion unit shown executing the third, second intake, stroke of the cycle, with additional fuel and air mixture being drawn into the cylinder from a vehicle carburetion system, drawn to the same scale, FIG. 4 the combustion unit shown at the end of the second transfer stroke, the fourth stroke of the cycle, transferring the second intake of fuel and air mixture to the holding chamber, drawn to the same scale, FIG. 5 the combustion unit shown drawing fuel from the holding chamber into the cylinder, drawn to the same scale, FIG. 6 the combustion unit shown at the end of the compression stroke, with all valves closed, pressurizing the fuel within the cylinder for combustion, drawn to the same scale, FIG. 7 the combustion unit shown during the power stroke of the cycle, the mixture in the cylinder being ignited by a spark plug, drawn to the same scale, FIG. 8 the combustion unit shown at the end of the exhaust stroke, the eighth and final stroke of the cycle, drawn to the scale of FIG. 1, FIG. 9 a fragment of the combustion unit of FIG. 1, showing the holding chamber valve being actuated electronically by a solenoid apparatus, drawn to the scale of FIG. 1, FIG. 10 a vertical sectional view of a fragment of the combustion unit of FIG. 1, showing the holding chamber with an additional port and closing valve for transferring fuel and air mixture from therein to the vehicle intake manifold, drawn to the scale of FIG. 1, FIG. 11 a view of a fragment of the combustion unit of FIG. 1, viewed however in the direction opposite from that shown in FIGS. 1–8, showing a fuel injection port at the inlet to the cylinder, drawn to the scale of FIG. 1, FIG. 12 the fragment as seen in FIG. 11, with the fuel injection port in the cylinder head, FIG. 13 the fragment of FIG. 11, showing the fuel injection port through the wall of the holding chamber and indicating the solenoid operated fuel injection unit, and FIG. 14 the fragment of FIG. 11, modified however to include a Diesel fuel injector instead of a sparking device.
Figure 4:
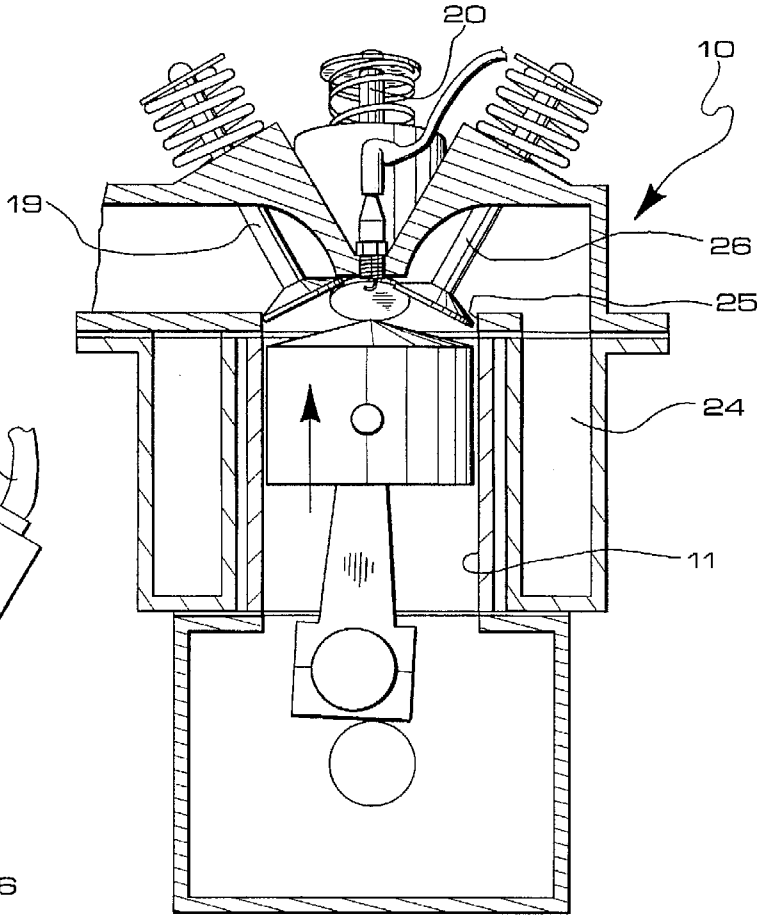

In FIG. 1, piston 12 is shown reaching its lowermost position at the end of a first, intake, stroke drawing fuel and air mixture through port 17 into cylinder 11 from a carburetion system, not shown. Exhaust valve 18 is closed during this stroke. Intake valve 19 is open to allow the fresh fuel and air mixture to be drawn into cylinder 11. Valve 26 is also open—to an amount allowing mixture to flow from chamber 24 into piston 12 to mix with incoming fuel and air mixture, so that the pressure in the two chambers are both atmospheric at the end of the first intake stroke. At the end of the stroke, intake valve 19 closes.

In FIG. 2, piston 12 is shown in uppermost position during the second stroke of the cycle, the first mixture transfer stroke. The holding chamber 24 is with this upward stroke charged with the mixture previously drawn into cylinder 11 during the first stroke, mixed with chamber contents remaining at the end of the previous eight-stroke cycle. See page 10. Exhaust valve 20 and combustible mixture intake valve 19 are both in their upward positions closing ports 18 and 17 respectively. The charge is forced through port 25 into the holding chamber 24 around downwardly positioned, open, chamber valve 26. At the end of this second stroke, the pressure within the holding chamber 24 becomes substantially elevated over ambient pressure, since it at this point contains both residual gases initially at atmospheric pressure and the just added additional charge. The chamber pressure at this point is a function of the relative sizes of the cylinder 11 and the holding chamber 24.

Piston 12 then moves downwardly in the next stroke, the third, which is another intake stroke drawing additional fuel and air mixture into cylinder 11 from the carburetion system. (FIG. 3) Holding chamber port 25 is closed during this stroke, trapping the pressurized contents of holding chamber 24. Intake valve 19 is open, and exhaust valve 20 is closed.

In FIG. 4, piston 12 is shown again in uppermost position, after completing the fourth stroke of the cycle. Holding chamber valve 26 only is open during this stroke. Piston 12 has forced the second charge of mixture into chamber 24 to mix with the previously charged mixture. The pressure in chamber 24 is now further elevated.

Figure 5:
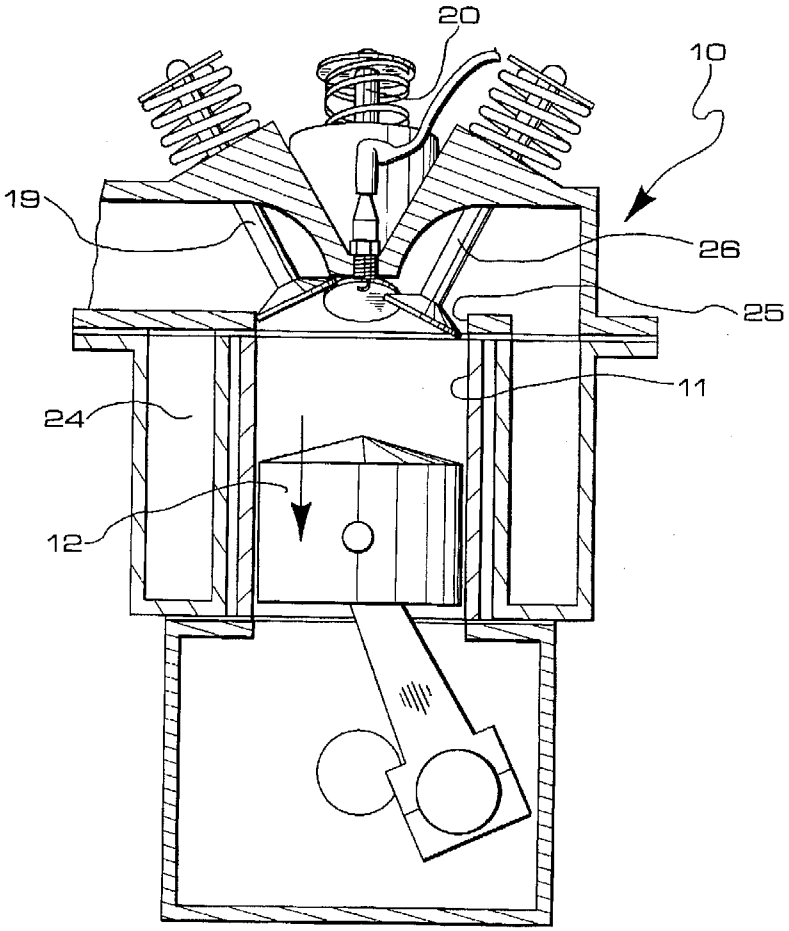

In FIG. 5, piston 12 is shown nearing the bottom of the fifth stroke of the cycle. Intake and exhaust valves 19 and 20 are closed. Holding chamber valve 26 is open to allow combustible mixture to flow into cylinder 11. When piston 12 reaches the bottom of this stroke, the pressure in cylinder 11 equals that in holding chamber 24, and both are substantially above ambient atmospheric pressure. As subsequently discussed, the level of pressure at this time depends upon the relative volumes of cylinder 11 and chamber 24.

Figure 6:
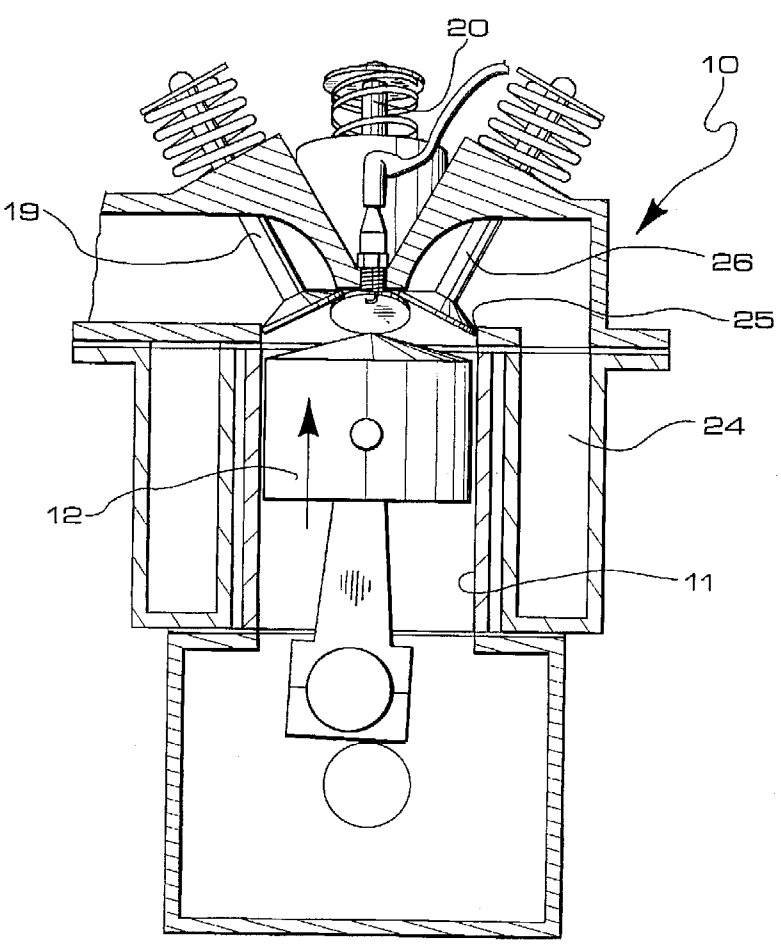

The next stroke of piston 12, the sixth, shown in FIG. 6, is the compression stroke. With piston 12 in its uppermost position, the gases in cylinder 11 are now compressed for ignition. During this upward stroke, all valves are closed. The pressure of the combustible mixture within the cylinder at the beginning of this compression stroke is considerably above atmospheric, increasing the amount of potential power therein. The capability of increased power per power stroke allows, for example, the use of a smaller engine for a desired power output, or increased power output from an engine of limited size.

Figure 8:
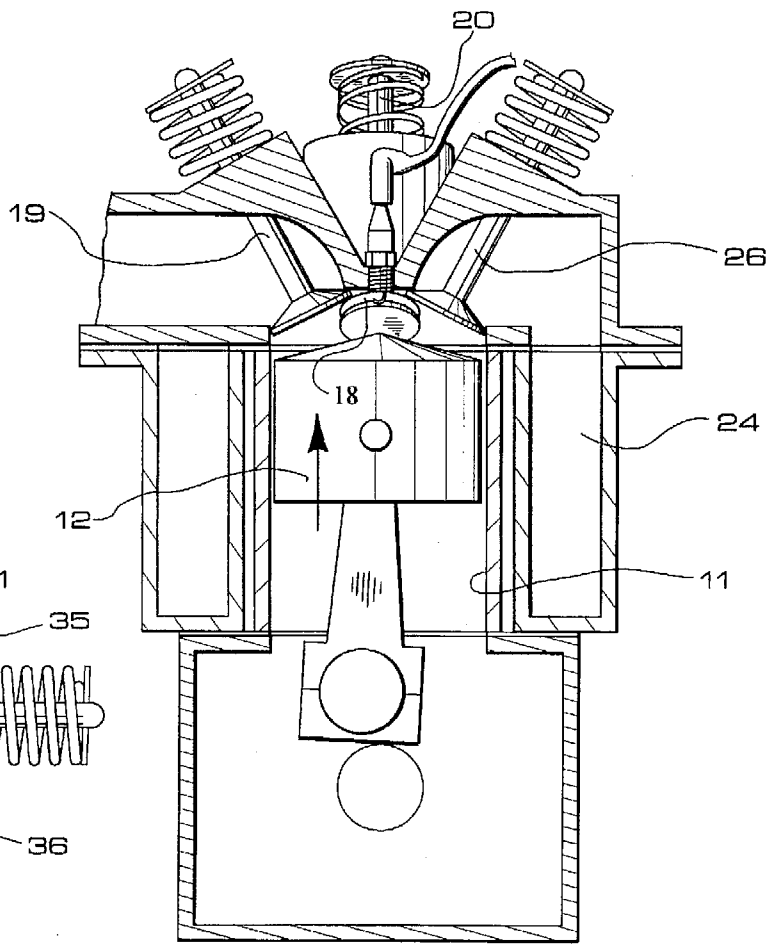
Figure 7:
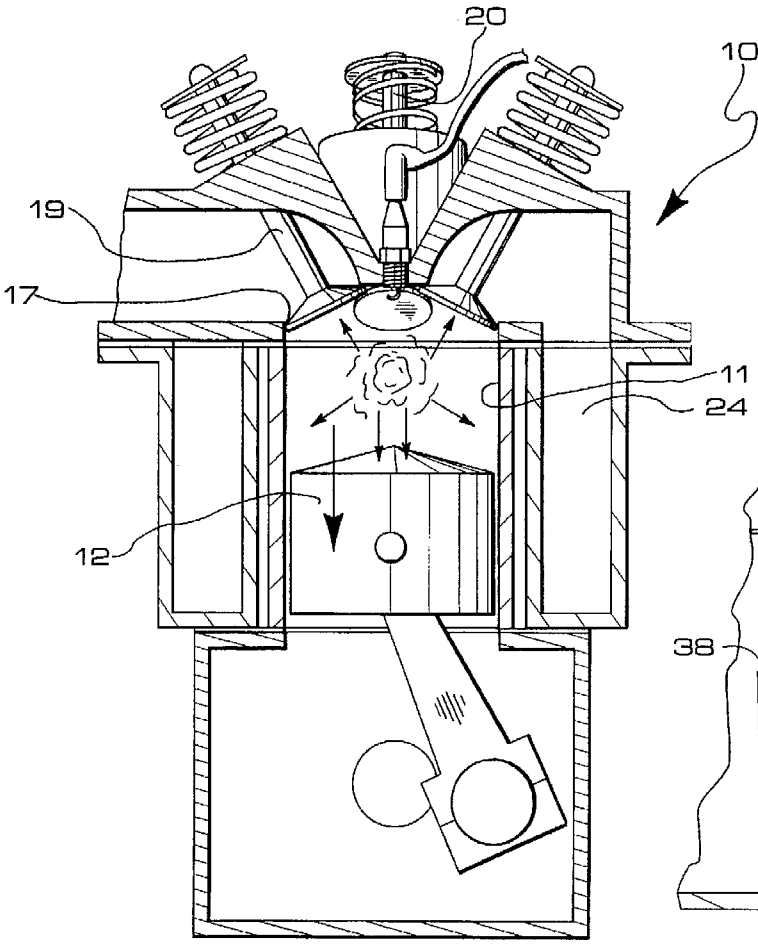

FIGS. 7 and 8 show the seventh and eighth, power and exhaust, strokes completing the cycle. All valves are closed during the downward power stroke of piston 12, while the exhaust port 18 is open during the upward exhaust stroke expelling residual combustion gases from cylinder 11.

Retained within holding chamber 24 is a volume of fuel and air mixture at a pressure greater than ambient atmospheric, which must be utilized in the next succeeding eight stroke cycle. To avoid chamber pressure buildup incrementally and accumulatively from cycle to cycle, valve 26 is, as described above, opened during the first stroke of the cycle. The flow rates permitted through intake and holding chamber ports 17 and 25 respectively by associated valves 19 and 26 must be selected as functions of the size, actual and relative, of cylinder 11 and holding chamber 24. Preferably, the actual and relative sizes of ports 17 and 25 are selected to provide the desired flow rates when both are fully opened by downward movement of the respective valves. However, the control of flow rates may also be achieved, for example, through design and controlled operation of cams 27 and 29.

During the transfers of mixtures between the cylinder 11 and the holding chamber 24, the fuel and air mixtures generally obey the pressure/volume relationships of gases as put forth in Boyle's law. For simplicity, the temperature changes resulting from the relatively small pressure changes may be ignored so that $$P(1)V(1)=P(2)V(2)$$

wherein P represents the pressure in the corresponding volume V. For example if the volume of the cylinder and the volume of the holding chamber are equal and are designated V(c) and V(hc) and the pressure in the cylinder is P(c) and the pressure in the holding chamber is P(hc), then $$P(c)V(c)=P(hc)V(hc)$$

and the pressure during the various strokes of the cycle will be related as shown in the table below

| Strokes | P(c) | P(hc) |
|---|---|---|
| 1. Intake | 1 atm | 1 atm |
| 2. Transfer | V(c) = 0 | 2 atm |
| 3. Intake | 1 atm | 2 atm |
| 4. Transfer | V(c) = 0 | 3 atm |
| 5. Reverse Transfer | 1½ atm | 1½ atm |
| 6. Compression | 1½ × Compression ratio | 1½ atm |
| 7. Power | residual at end of stroke | 1½ atm |
| 8. Exhaust | V(c) = 0 | 1½ atm |
| 1. Intake | 1 atm | 1 atm |
| . . | . | . |
| . . | . | . |
| . . | . | . |

Figure 10:
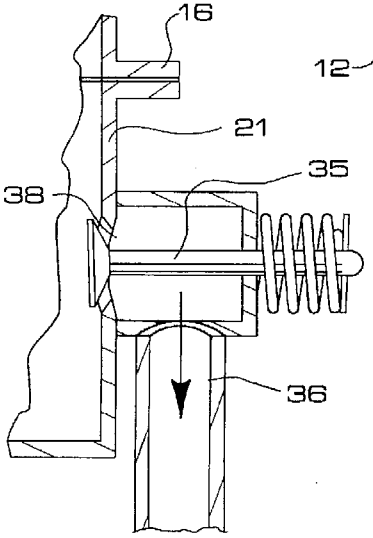

Embodiments of engine 10 which differ from that described and illustrated in detail may nevertheless be within the spirit of the invention. For example, the equalization of pressure in cylinder 11 and holding chamber 24 during the first stroke of each eight-stroke cycle may be achieved by a chamber bleed valve 35 controlling flow through a bleed port 38, instead of by opening of holding chamber valve 26. (FIG. 10) In this embodiment, holding chamber valve 26 would be closed during the first stroke and intake valve 19 would be open. Bleed valve 35 would be open, allowing stored mixture to flow from chamber 24 through bleed tube 36 to the engine intake manifold, not shown. This previously stored mixture would be then drawn into cylinder 11 at atmospheric pressure, mixed with newly carbureted mixture, during this first intake stroke of the succeeding eight-stroke cycle. Valve 35 may be actuated and timed by action of a cam, not shown, similar to the intake, exhaust and holding chamber valve cams. Or, it could be electronically actuated as described below.

Figure 9:
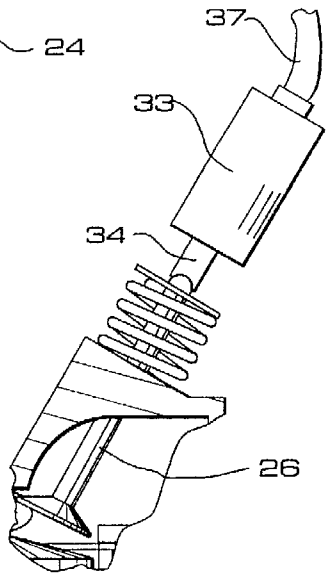
Figure 3:
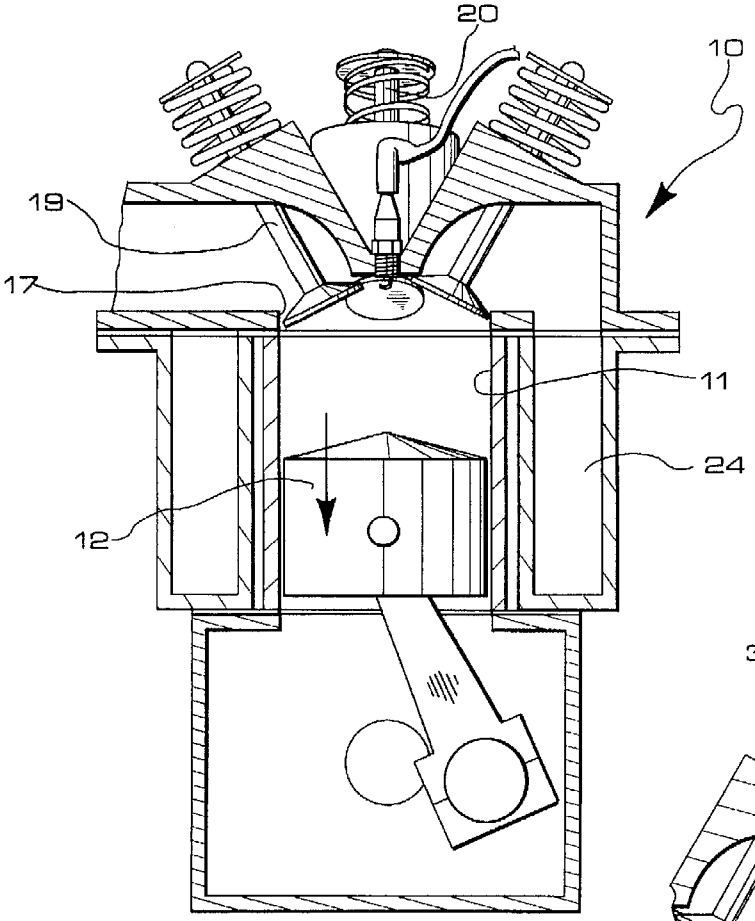

The valves 19, 20, 26 and 35 could if desired be actuated electronically by providing a solenoid 33 with an actuating stem 34. (FIG. 9) Actuating current pulses through lead cable 37 would be synchronized with crankshaft rotation throughout the eight stroke cycle.

Figure 11:
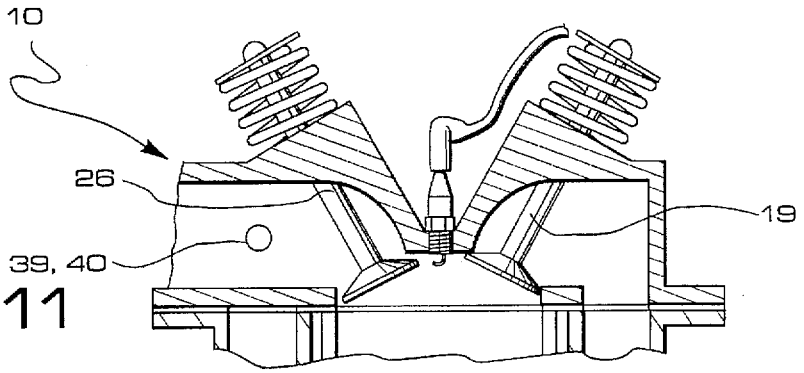
Figure 12:
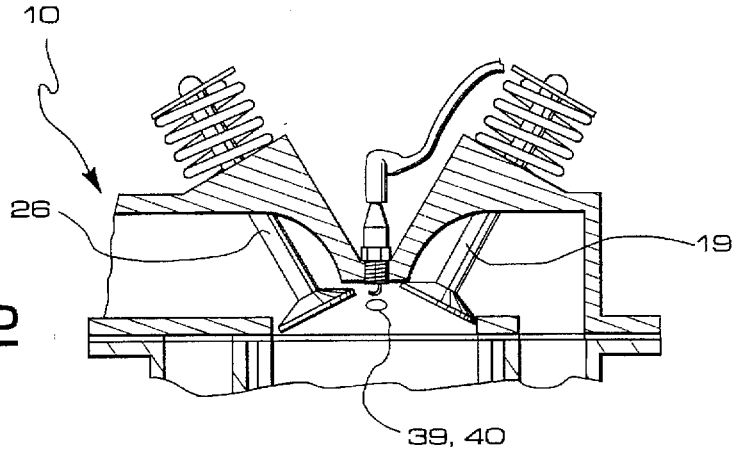
Figure 13:
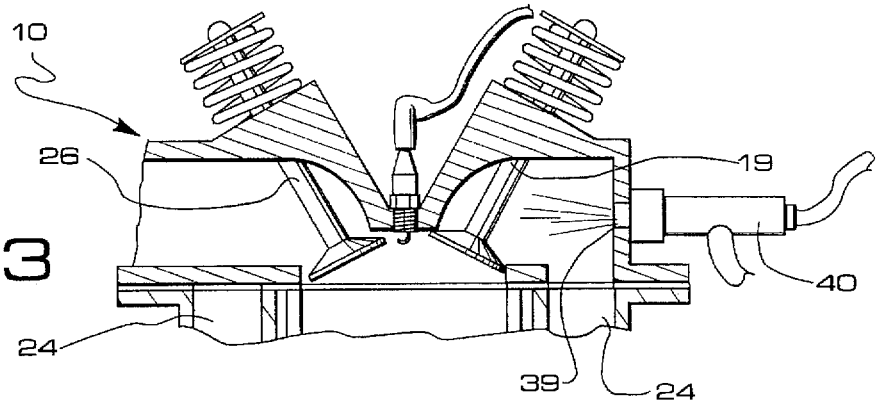

The foregoing description and illustrations of the inventive engine presumes carburetion of the air of the fuel and air mixture followed by intake into cylinder 11. However, an engine providing carburetion by fuel injection into air previously drawn into cylinder 11 is within the scope and spirit of the invention. The fuel injection system may introduce fuel into an incoming stream of air during each of the two intake strokes shown in FIG. 1 and FIG. 3, in which case the foregoing description remains entirely applicable. However, the fuel may alternatively be injected directly into cylinder 11 after intake of fuel free air, or into the holding chamber 24 after or during one or both of the transfer strokes shown in FIG. 2 and FIG. 4. FIGS. 11, 12 and 13 indicate alternate locations of a fuel injection port 39, respectively at the inlet of cylinder 11, through the closure head 16, and into the holding chamber 24. A solenoid operated fuel injection unit 39 is indicated in FIG. 13. With cylinder head location, injector 40 would operate during both intake strokes. However, the amount of fuel injected would be adjusted during the first intake stroke to compensate for the reduced fresh air intake.

Figure 14:
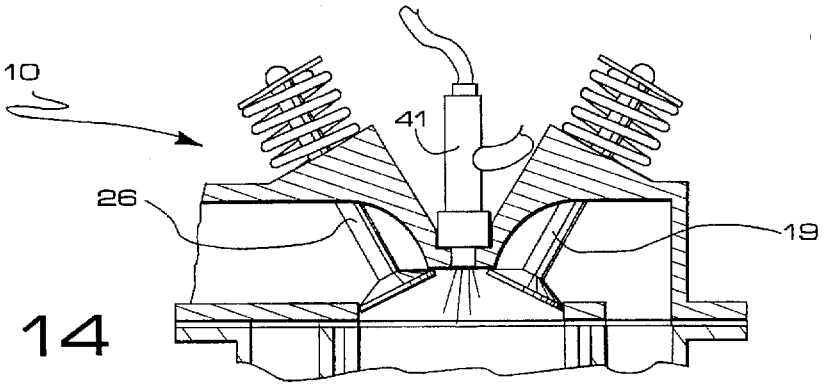

The eight-stroke cycle engine 10 may also be designed for Diesel type operation. (FIG. 14) The sparking device 23 is replaced by a Diesel fuel injector 41. The first five strokes of the Diesel cycle (Intake, transfer, intake, transfer and intake into cylinder from holding chamber) are performed using uncarbureted air from the surrounding atmosphere. Carburetion is then implemented during the compression stroke 6 by discharge of fuel into cylinder 11 by Diesel fuel injector 41. The resulting fuel and air mixture is then ignited by heat of compression, and power stroke seven and exhaust stroke eight follow.

The inventive apparatus and method may be embodied in still other specific forms without departing from the spirit or essential characteristics thereof. The present embodiments are, therefore, to be considered as illustrative and not restrictive, the scope of the invention being indicated by the appended claims rather than by the foregoing description and all changes that come within the meaning and range of equivalency of the claims are therefore intended to be embraced therein:

What is claimed and desired to be secured by United States Letters Patent is:

1. An engine having at least one internal combustion unit comprising:

a wall member enclosing an elongate hollow cylinder;

a piston member mounted to reciprocate sealingly within the cylinder;

end pivoted linkage means connecting the piston member to a crankshaft, so that rotation thereof is accompanied by reciprocating strokes of the piston within the cylinder;

cylinder closure means carrying a port for intake of ambient air into the interior of the cylinder, and a port for exit of residual gases from the cylinder after combustion of a fuel and air mixture therein;

a valve opening and closing the intake port and a valve opening and closing the exhaust port;

walls forming a closed air holding chamber;

a port communicating between the holding chamber and the cylinder;

a valve for opening and closing the port between the holding chamber and the cylinder;

means for adding liquid fuel at least to the air within the cylinder, to provide a combustible fuel and air mixture;

means for igniting the combustible mixture of fuel and air within the cylinder;

means opening closing each of the valves synchronously with crankshaft rotation and piston member reciprocation within the cylinder as required by an engine operating cycle including eight strokes of the piston member; and means activating the ignition means at the required time in said cycle to initiate a single power producing stroke of the piston member.

2. The internal combustion engine of claim 1, wherein:

the means for adding liquid fuel is selected from among a system carburizing a stream of ambient air along with passage means directing said stream to the port for intake of ambient air into the cylinder, a fuel injection device selectively located to discharge at the intake port outside the intake port valve, into the holding chamber and into the cylinder, wherein the latter fuel injection device is selected for use with Diesel fuel or lighter liquid hydrocarbon fuels.

3. The internal combustion engine of claim 2, wherein:

the ignition means comprises a spark producing device; and the fuel is a lighter liquid hydrocarbon.

4. The internal combustion engine of claim 2, wherein:

the fuel is a Diesel hydrocarbon; and the ignition means comprises raising the temperature of a fuel and air mixture within the cylinder to an automatic ignition level by a compression stroke of the piston member.

5. A method of combusting liquid fuel and an air mixtures to extract mechanical power therefrom, comprising the steps:

providing a quantity of compressed air in a holding chamber;

transferring compressed air from the holding chamber into a combustion chamber;

adding liquid hydrocarbon fuel to the air to produce a combustible fuel and air mixture;

further compressing the air in the combustion chamber;

combusting the mixture in the combustion chamber, converting said mixture to highly pressurized gaseous products of combustion; and extracting mechanical power from the pressurized gases in the combustion chamber.

6. The method of combusting liquid fuel and air mixtures of claim 5, wherein:

the liquid hydrocarbon fuel is added to only the air in the combustion chamber transferred from the holding chamber.

7. The method of combusting liquid fuel and air mixtures of claim 5, wherein:

the compressed air is provided in the holding chamber by transferring all of the air initially in the combustion chamber into the holding chamber to mix with the air initially therein, and retaining said air therein in pressurized condition; and the combustion chamber is filled with air which is transferred to the holding chamber, increasing the pressure of the air therein.

8. A method for combustion of fuel and air mixtures to extract power therefrom, comprising the steps:

providing at least one combustion unit comprising a cylindrical combustion chamber with a piston journaled to reciprocate sealably therein connected to a crankshaft which turns as the piston reciprocates, an air holding chamber connected through a port to the combustion chamber, and associated valving for admitting and retaining air into and within the combustion chamber and exhausting residual products of combustion therefrom, and opening and closing the holding chamber port;

drawing a charge of air into the combustion chamber with a downward motion of the piston with the holding chamber port open, said charge comprising a mixture of ambient air and contents retained in the holding chamber at the end of a preceding eight-stroke cycle, and transferring said mixture into the holding chamber by a following upward motion of the piston, and closing the holding chamber valve means to retain the mixture therein;

drawing a second charge of ambient air into the combustion chamber by a downward motion of the piston therein, and transferring said second charge under pressure into the holding chamber by a following upward stroke of the piston, to mix with said previously transferred mixture therein;

drawing holding chamber contents into the combustion chamber by a downward stroke of the piston;

carburizing at least the air within the combustion chamber to produce a desired combustible fuel and air mixture by adding liquid hydrocarbon to the air by means selected from among providing and employing a system carburizing a stream of ambient air and passage means directing said stream to the port for intake of ambient air into the cylinder, providing and employing a fuel injection device selectively located to discharge at the intake port outside the intake port valve, into the holding chamber, wherein the latter fuel injection device is selected for use with either Diesel or lighter liquid hydrocarbon fuels;

compressing the fuel and air mixture within the combustion chamber by an upward stroke of the piston therein;

igniting said mixture by means selecting from among providing and employing a spark producing device in the combustion chamber, and designing the engine to provide compression temperature rise to the ignition point of the mixture within the combustion chamber, so that the piston is driven downward to turn the crankshaft to produce output power from the engine; and purging the combustion chamber of residual products of combustion by a final upward piston stroke of the cycle with intake and holding chamber ports closed and the exhaust port open.

9. The method of claim 8, wherein:

the holding chamber valve is opened during the drawing of the first fuel and air mixture into the combustion chamber by the first downward stroke of the piston, so that the retained air therein mixes with the newly carbureted mixture at one atmosphere within both the cylinder and the holding chamber.

10. The method of claim 8, wherein:

the combustion unit further comprises tube means bleeding the holding chamber to a mixture inlet manifold and valve means controlling the flow through said tube means;

the holding chamber valve is closed during the drawing of the first fuel and air mixture into the combustion chamber by the first downward stroke of the piston, and the bleed valve means is open allowing mixture to flow from the holding chamber to the mixture inlet manifold to mix with newly carbureted mixture during the stroke, so that the pressure in both the cylinder and the holding chamber are at one atmosphere at the end of said first downward piston stroke.

* * * * *